US005659902A

United States Patent [19]

Roberts, Jr.

[11] Patent Number: 5,659,902

[45] Date of Patent: Aug. 26, 1997

[54] TOILET SEAT LIFT

[76] Inventor: Wayne G. Roberts, Jr., 27563 Lake Sabrina Dr., Holden, La. 70079

[21] Appl. No.: 604,602

[22] Filed: Feb. 21, 1996

[51] Int. Cl.[6] ..... A47K 13/10

[52] U.S. Cl. ..... 4/246.3

[58] Field of Search ..... 4/246.1, 246.3

[56] References Cited

U.S. PATENT DOCUMENTS

| | | | |
|---|---|---|---|
| 2,954,565 | 10/1960 | Miller | 4/251 |
| 4,150,446 | 4/1979 | Crocker | 4/246.3 |
| 4,426,743 | 1/1984 | Seabrooke | 4/246.3 |
| 4,470,161 | 9/1984 | Seabrooke | 4/251 |
| 5,404,595 | 4/1995 | Carmel | 4/246.1 |

FOREIGN PATENT DOCUMENTS

| | | | |
|---|---|---|---|
| 0531962 | 6/1958 | Italy | 4/246.1 |

*Primary Examiner*—Charles E. Phillips
*Attorney, Agent, or Firm*—Joseph N. Breaux

[57] ABSTRACT

A toilet seat lift including a foot operated cable push/pull mechanism; a cable assembly; and a cable anchoring mechanism. The cable assembly includes a sheath that is attachable to the underside of an existing pivoting toilet seat. The push/pull mechanism pushes and pulls a cable disposed through the sheath and having an end anchored to the rim of the toilet bowl. When the cable is pushed, the cable generates a force between the pivoting toilet seat and the cable anchoring mechanism that acts to cause the pivoting toilet seat to pivot upward.

15 Claims, 2 Drawing Sheets

TOILET SEAT LIFT

TECHNICAL FIELD

The present invention relates to devices for lifting toilet seats and more particularly to a device for lifting the seat of a toilet that utilizes an adhesively secured cable anchoring mechanism and in combination with a sheathed cable in a compression mode to lift the toilet seat.

BACKGROUND ART

Toilet seats, such as in public restroom facilities, are often soiled and contaminated with urine. The soiling occurs because individuals utilizing the toilet do not like to touch the toilet seat. It would be a benefit, therefore, to have a device actuated by the foot of a user that would lift and lower the toilet seat to allow those individuals who do not wish to touch the toilet seat to lift and lower the toilet seat without fear of contamination. It would be a further benefit if the lifting device were easily attachable to an existing toilet.

GENERAL SUMMARY DISCUSSION OF INVENTION

It is thus an object of the invention to provide a toilet seat lift that is foot actuated.

It is a further object of the invention to provide a toilet seat lift that is easily installed on existing toilets.

It is a still further object of the invention to provide a toilet seat lift that accomplishes both of the above objects in combination.

Accordingly, a toilet seat lift is provided. The toilet seat lift comprising a foot operated cable push/pull mechanism having a push/pull arm including a first cable gripping member; a first length of cable having a portion thereof slidingly disposed within a flexible sheathing of a second length shorter than the first length, a first cable end of the cable being secured to the push/pull arm with the first cable gripping member, the flexible sheathing including a plurality of anchoring brackets having an adhesive portion suitable for adhering to ceramic materials; and a toilet bowl cable anchoring mechanism including a right angle bracket having a section of adhesive material suitable for adhering to ceramic materials disposed on a first surface thereof, the section of adhesive material being covered with a peel away cover member, and a cable anchoring member disposed on a second surface thereof opposite the first surface, the cable anchoring member having a tubular shaped gripping portion into which a second end of the cable is secured. The cable push pull mechanism includes a mounting bracket having a mounting aperture adapted for connection with one of the existing toilet bowl floor anchoring bolts, a push/pull arm in functional connection with a lift foot pedal in a manner such that displacement of the lift foot pedal in a first direction causes the push/pull arm to move in a pushing direction, and a release pedal in connection with the push/pull arm in a manner such that displacement of the release pedal in the first direction causes the push/pull arm to move in a pulling direction.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
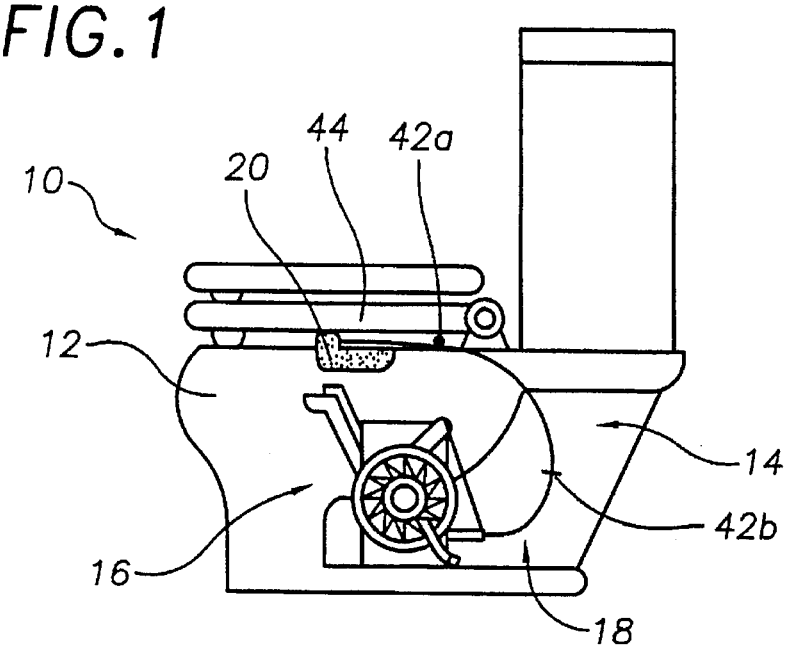
FIG. 1 is a side view of a representative toilet with an exemplary embodiment of the toilet seat lift of the present invention installed.

FIG. 1 shows a side view of a representative, conventional, floor mounted, toilet 10 having a toilet bowl 12 bolted to the floor of a building. Also shown is an exemplary embodiment of the toilet seat lift of the present invention, generally designated by the numeral 14, installed on toilet 10. Toilet seat lift 14 includes a foot operated cable push/pull mechanism, generally designated by the numeral 16; a cable assembly, generally designated by the numeral 18, and a cable anchoring mechanism 20.

Figure 2:
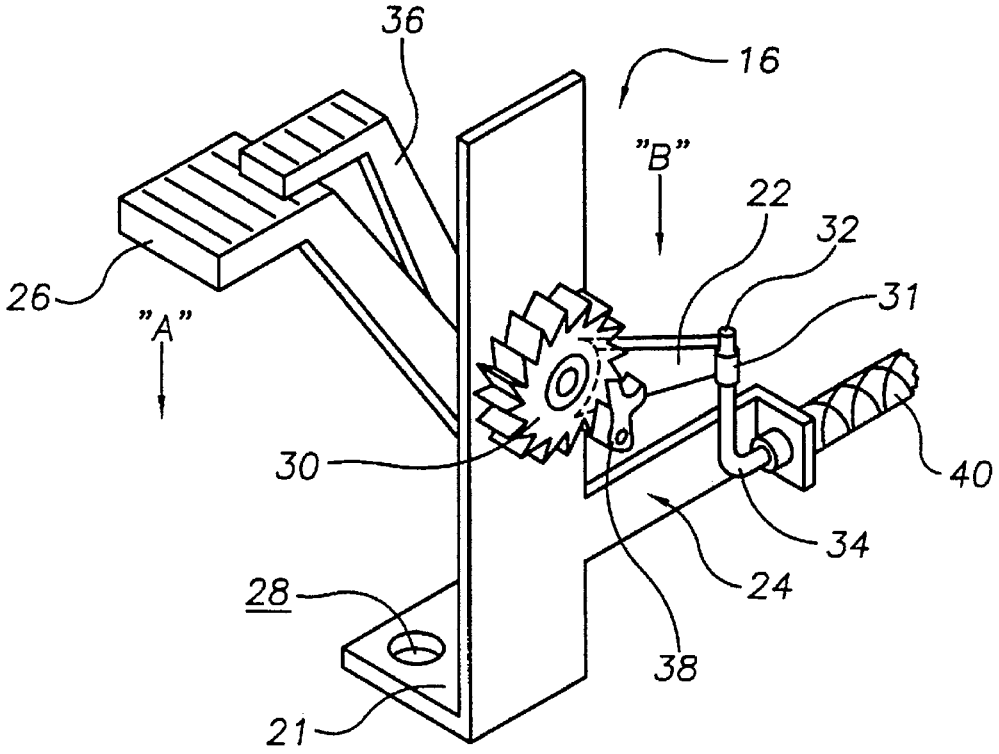
FIG. 2 is a perspective detail view of an exemplary foot operated cable push/pull mechanism including a push/pull arm having a first cable gripping member secured to a first end of the cable.

FIG. 2 shows an exemplary foot operated cable push/pull mechanism 16 in isolation. Push/pull mechanism 16 includes including a mounting bracket 21; a push/pull arm 22, a push/pull arm position locking mechanism, generally designated by the numeral 24; and a lift foot pedal 26. Mounting bracket 21 includes a mounting aperture 28 sized to allow one of the floor anchoring bolts of toilet 10 to be inserted therethrough. Push/pull arm 22 extends outwardly from a locking gear 30 that makes up a portion of push/pull arm locking mechanism 24. A far end of push pull arm 22 includes a crimpable, first cable gripping member 31 that has had a first end 32 of a first length of cable 34 crimp secured therein. Push/pull arm 22 is connected to lift foot pedal 26 through a gearing mechanism (not shown) in a manner such that displacement of the lift foot pedal in a first direction "A" causes push/pull arm 22 to move in a pushing direction "B".

Push/pull arm position locking mechanism 24 includes locking gear 30, a release pedal 36 and a locking pawl 38. Locking pawl 38 engages locking gear 30 and prevents push/pull arm 22 from moving in a pulling direction that is opposite pushing direction "B". Pressing down on release pedal 36 disengages locking pawl 38 from locking gear 30 and causes push/pull arm to move in the pulling direction.

Also shown in FIG. 2 is a section of cable sheathing 40 through which a portion of cable 34 is slidably disposed. With reference once again to FIG. 1, sheathing 40 has first and second anchoring brackets **42*a*,42*b*. Each anchoring bracket 42*a*,42*b* includes a section of adhesive material suitable for adhesively securing the anchoring bracket 42*a*, 42*b* in place to a ceramic or plastic material. Anchoring bracket 42*a* is positioned at a first end of cable sheathing 40 and is installed to an underside surface of a pivoting toilet seat 44. Anchoring bracket 42*b* is attached to an exterior sidewall of toilet bowl 14**.

Figure 3:
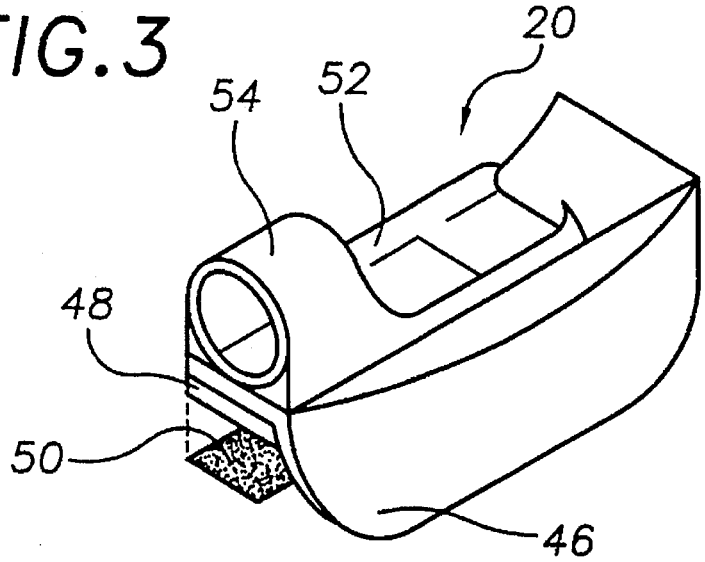
FIG. 3 is a perspective view of an exemplary cable anchoring member showing the right angle bracket including the section of adhesive, the peel away cover member, and the cable anchoring member including the tubular shaped gripping portion that is utilized to secure the second end of the cable.

With reference to FIG. 3, toilet bowl cable anchoring mechanism 20 includes a right angle bracket 46 having an section 48 of adhesive material positioned on an interiorly facing surface. Adhesive section 48 is covered with a peel away cover member 50, shown exploded away from adhesive section 48. A cable anchoring member 52 is disposed on a second surface of right angle bracket 46 that is opposite the interiorly facing surface having adhesive section 48. Cable anchoring member 52 has a crimpable, tubular shaped gripping portion 54. During installation, a second end of cable 34 is secured within gripping portion 54.

Figure 4:
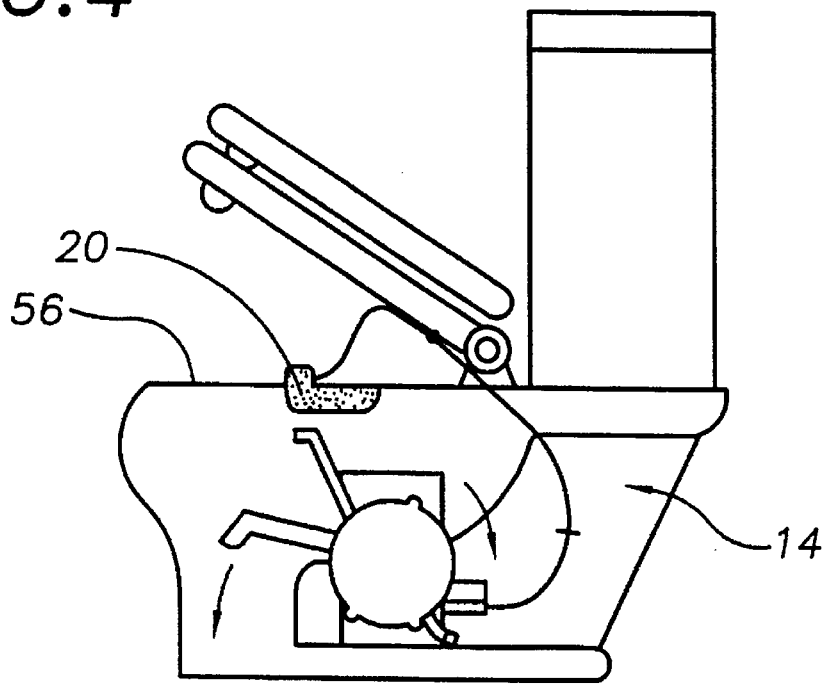
FIG. 4 is a side view of the representative toilet of FIG. 1 showing the toilet seat in a partially lifted position.

With reference to FIG. 4, toilet bowl anchoring mechanism 20 is secured to the rim 56 of toilet bowl 14 by removing peel away cover member 50 and contacting a top surface of the rim with adhesive section 48.

Operation of toilet seat lift 14 is now described with general reference to FIGS. 1–4. Push/pull mechanism 16 is installed on a toilet 10 by removing the existing nut from one of the floor anchoring bolts, positioning the end of the floor anchoring bolt through mounting aperture 28 of mounting bracket 21, and then replacing the existing nut. Once push/pull mechanism 16 is installed toilet bowl anchoring mechanism 20 is secured to the rim 56 of toilet bowl 12 by removing peel away cover member 50 and contacting a top surface of the rim with adhesive section 48. The first anchoring bracket 42*a* is installed to an underside surface of a pivoting toilet seat 44 and second anchoring bracket 42*b* is attached to an exterior sidewall of toilet bowl 12. It is important to leave a gap of about two and one-half inches between tubular shaped gripping portion 54 of cable anchoring mechanism 20 and first anchoring bracket 42*a*. The second end of cable 34 is then inserted into tubular shaped gripping portion 54 and securely crimped in place. With push/pull arm 22 moved into the farthest position in the pulling direction, first end 32 of cable 34 is inserted into first cable gripping member 31 and securely crimped in place.

Operation of toilet seat lift 14 is as follows. Depressing lift foot pedal 26 in the first direction "A" causes push/pull arm 22 to move in a pushing direction "B". As push/pull arm 22 travels in direction "B", cable 34 is pushed through sheathing 40 and exerts a force against cable anchoring mechanism 20. Because cable anchoring mechanism 20 is secured to the rim of toilet bowl 14 a force is generated between pivoting toilet seat 44 and cable anchoring mechanism 20 that acts to cause pivoting toilet seat 44 to pivot upward, as shown in FIG. 4. When it is desired to lower pivoting toilet seat 44, release pedal 36 is depressed in the direction "B" disengaging locking pawl 38 from locking gear 30 and causing push/pull arm 22 to move in the pulling direction. As push/pull arm travels in the pulling direction, cable 34 is pulled through sheathing 40. This removes the force generated between pivoting toilet seat 44 and cable anchoring mechanism 20 and causes pivoting toilet seat 44 to pivot downward, as shown in FIG. 1.

It can be seen from the preceding description that a toilet seat lift has been provided that is foot actuated and that is easily installed on existing toilets.

It is noted that the embodiment of the toilet seat lift described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A toilet seat lift comprising:

a foot operated cable push/pull mechanism having a push/pull arm including a first cable gripping member;

a first length of a cable having a portion thereof slidingly disposed within a flexible sheathing of a second length shorter than said first length, a first cable end of said cable being secured to said push/pull arm with said first cable gripping member, said flexible sheathing including a plurality of anchoring brackets each having an adhesive portion suitable for adhering to ceramic materials; and a toilet bowl cable anchoring mechanism including a right angle bracket having a section of adhesive material suitable for adhering to ceramic materials disposed on a first surface thereof, said section of adhesive material being covered with a peel away cover member, and a cable anchoring member disposed on a second surface thereof opposite said first surface, said cable anchoring member having a tubular shaped gripping portion into which a second end of said cable is secured;

said cable push pull mechanism including a mounting bracket having a mounting aperture adapted for connection with one floor anchoring bolt of an existing toilet bowl, said push/pull arm being in functional connection with a lift foot pedal in a manner such that displacement of said lift foot pedal in a first direction causes said push/pull arm to move in a pushing direction, and a release pedal in connection with said push/pull arm in a manner such that displacement of said release pedal in said first direction causes said push/pull arm to move in a pulling direction.

2. The toilet seat lift of claim 1, wherein:

said push/pull arm extends outwardly from a locking gear that makes up a portion of a push/pull arm locking mechanism.

3. The toilet seat lift of claim 2, wherein:

said first cable gripping member is crimpably securable to said first cable end.

4. The toilet seat lift of claim 3 wherein:

one of said plurality of anchoring brackets is positioned at a first end of said flexible sheathing.

5. The toilet seat lift of claim 4 wherein:

said tubular shaped gripping portion is crimpably securable to said second end of said cable.

6. The toilet seat lift of claim 3 wherein:

said tubular shaped gripping portion is crimpably securable to said second end of said cable.

7. The toilet seat lift of claim 2 wherein:

one of said plurality of anchoring brackets is positioned at a first end of said flexible sheathing.

8. The toilet seat lift of claim 2 wherein:

said tubular shaped gripping portion is crimpably securable to said second end of said cable.

9. The toilet seat lift of claim 1, wherein:

said first cable gripping member is crimpably securable to said first cable end.

10. The toilet seat lift of claim 9 wherein:

one of said plurality of anchoring brackets is positioned at a first end of said flexible sheathing.

11. The toilet seat lift of claim 10 wherein:

said tubular shaped gripping portion is crimpably securable to said second end of said cable.

12. The toilet seat lift of claim 9 wherein:

said tubular shaped gripping portion is crimpably securable to said second end of said cable.

13. The toilet seat lift of claim 1 wherein:

said tubular shaped gripping portion is crimpably securable to said second end of said cable.

14. The toilet seat lift of claim 1 wherein:

one of said plurality of anchoring brackets is positioned at a first end of said flexible sheathing.

15. The toilet seat lift of claim 14 wherein:

said tubular shaped gripping portion is crimpably securable to said second end of said cable.

* * * * *